United States Patent [19]

Wagner

[11] 3,963,180

[45] June 15, 1976

[54] AIRLESS GUN NOZZLE GUARD

[75] Inventor: Josef Wagner, Friedrichshafen, Germany

[73] Assignee: Spray Tech Corporation, Minneapolis, Minn.

[22] Filed: Aug. 11, 1975

[21] Appl. No.: 603,676

[52] U.S. Cl. ..... 239/288.5; 239/DIG. 22

[51] Int. Cl.[2] ..... B05B 1/28; B05B 15/04

[58] Field of Search ..... 239/104, 105, 103, 288, 239/288.3, 288.5, 82, 83, 150, DIG. 22, 270; 128/173 H, 225, 249, 368; 222/402.12; 4/165

[56] References Cited

UNITED STATES PATENTS

| | | | |
|---|---|---|---|
| 2,270,579 | 1/1942 | Chamberlin et al. | 239/105 X |
| 2,597,573 | 5/1952 | De Groff | 239/288 |
| 2,676,841 | 4/1954 | Pohle | 239/150 X |
| 2,797,963 | 7/1957 | Wilson | 239/105 |
| 3,314,426 | 4/1967 | Carroll | 128/249 X |
| 3,550,857 | 12/1970 | Ahlberg | 239/288 |

*Primary Examiner*—Robert S. Ward, Jr.
*Attorney, Agent, or Firm*—Hill, Gross, Simpson, Van Santen, Steadman, Chiara & Simpson

[57] ABSTRACT

A safety nozzle assembly for airless paint spray pistols including a guard member which extends downstream of the pistol and which receives the nozzle member in one end. The guard member has an increasing cross-section downstream of the nozzle accommodating a fan spray from the nozzle, the guard member having a generally flattened oval cross-section downstream of the nozzle and terminating in a discharge end which is arcuately curved along a radius generated adjacent the nozzle.

10 Claims, 8 Drawing Figures

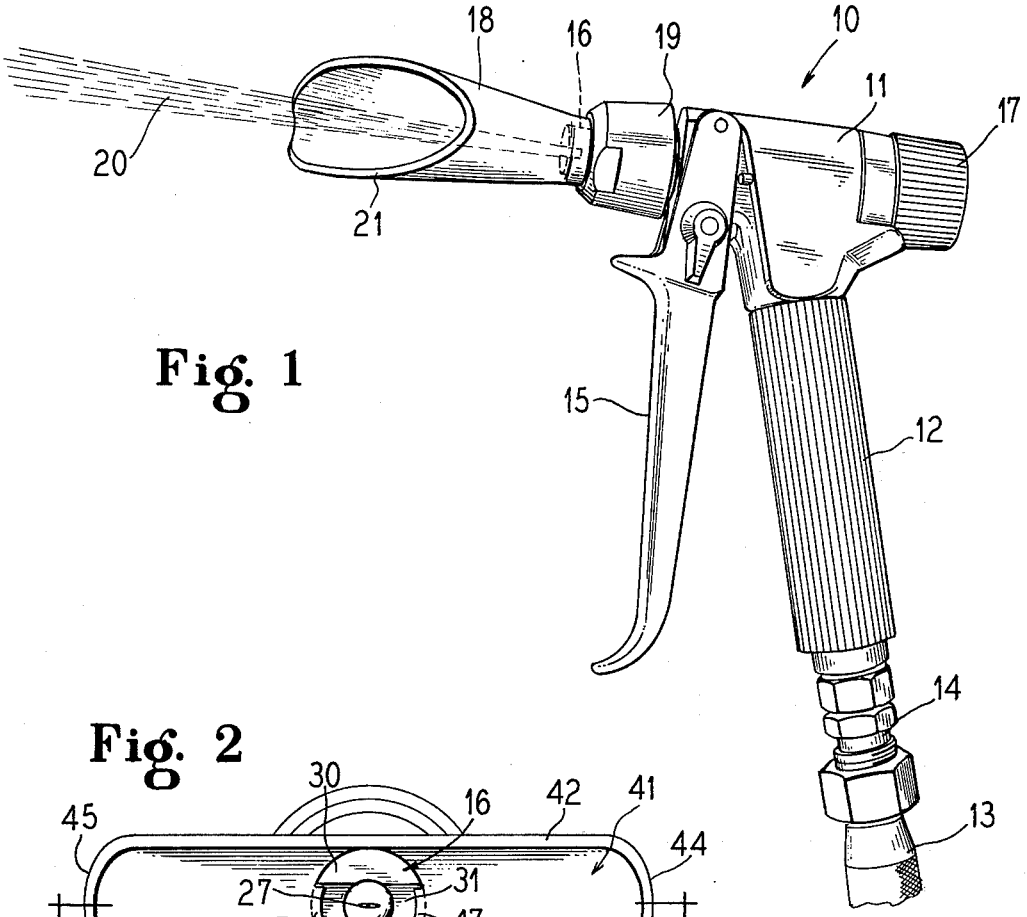
Fig. 1
Fig. 2
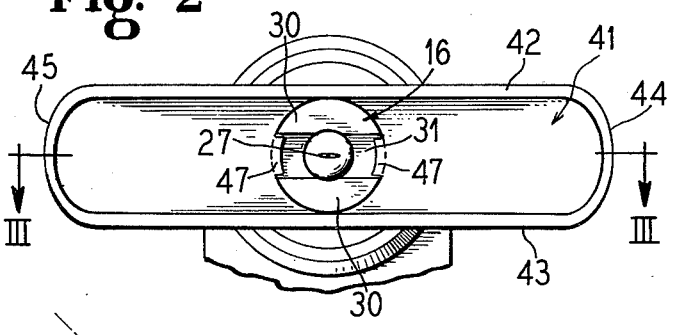
Fig. 4
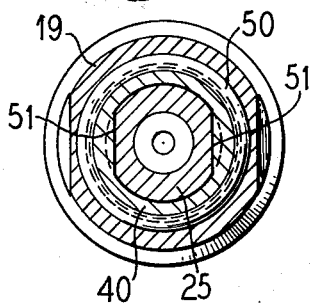
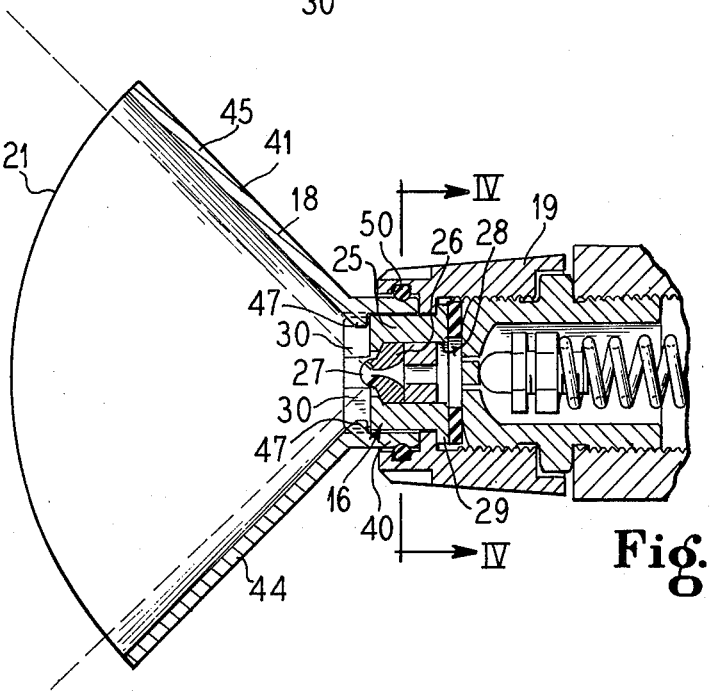
Fig. 3

Fig. 5
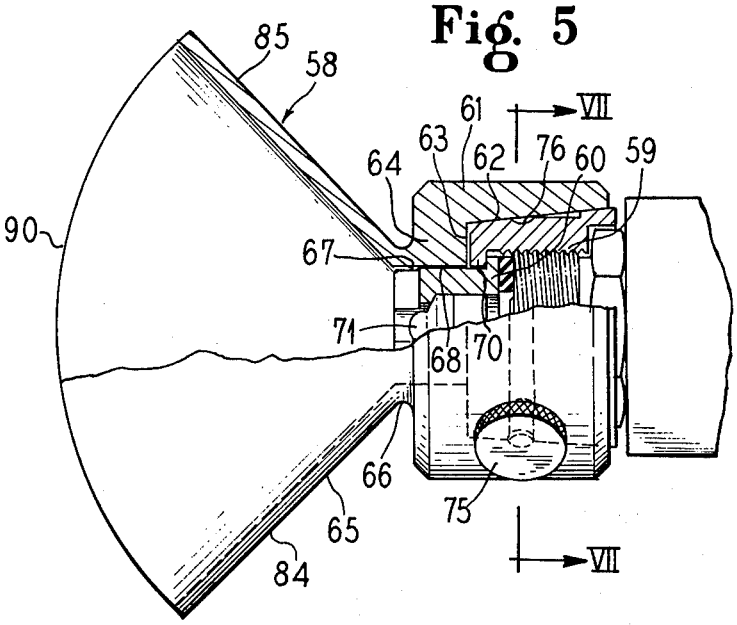
Fig. 6
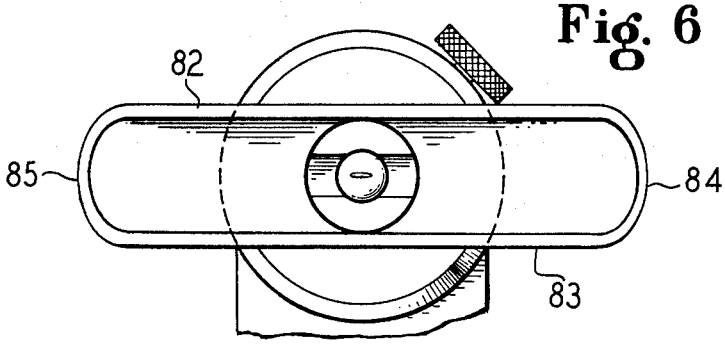
Fig. 8
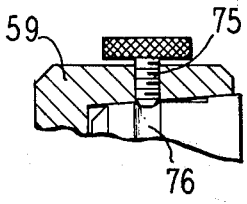
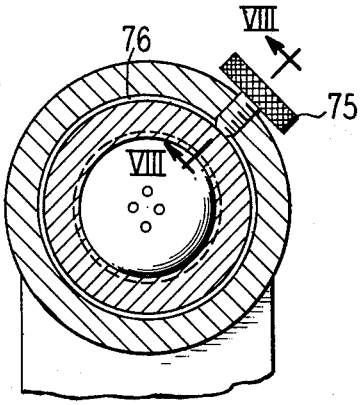
Fig. 7

AIRLESS GUN NOZZLE GUARD

BACKGROUND OF THE INVENTION

1. Field of the Invention

This invention relates to airless spray equipment and more particularly to a safety nozzle assembly for airless spray pistols.

2. Prior Art

Airless paint spray pistols having a pistol-like body member with pumped fluid passageways therethrough which terminate in a forwardly directed nozzle and which utilize a trigger controlled valve assembly for controlling passage of the pumped fluid to the nozzle are known to the art. Such spray pistols normally have a nozzle tip attached at the discharged end by fastening means such as a tip nut with the tip projecting beyond the end of the tip nut. The tip terminates in an axial end face which has a nozzle orifice therethrough communicating to the internal passageways in the spray pistol body. In most instances the nozzle orifice is slot-like, or designed to produce a fan spray pattern downstream of the orifice having substantially an oval cross-section. Examples of such prior art spray pistols may be found in U.S. Pat. No. 3,743,188 issued July 3, 1973 to J. Wagner; U.S. Pat. No. 3,836,082 issued Sept. 17, 1974 to Krohn; U.S. Pat. No. 3,844,487 issued Oct. 29, 1974 to Malec and U.S. Pat. No. 2,969,926 issued Jan. 31, 1961 to Peeps. Such patents reflect, generally, the standard types of prior art airless paint spray pistols.

Airless spray pistols have one common feature. Because they are airless units, only paint or other pumped fluid exits the nozzle. In order to move the pumped fluid at a sufficient volume, extremely high pressures are utilized. In fact, it has been known to use operating pressures between 3,300–3,600 pounds per square inch and theoretical maximum pressures on the order of 6,000 p.s.i. have been envisioned although for normal nozzle sizes the usual operating pressure range is between 900 and 2900 p.s.i. These pressures still exceed those found in prior art non-airless spray pistols.

Because such high pressures are used, the pressure-mass-velocity of the pumped fluid through the nozzle orifice is extremely high and the exiting stream can, in some instances, penetrate human flesh when the flesh is positioned closely adjacent the nozzle orifice. When such penetration occurs, the fluid injected through the flesh will spread out along the underlying muscle layer, and, especially when the fluid is toxic, cause serious injury which, if not correctly treated can, at times, result in peremanent injury.

Although it is known that such flesh penetration can occur immediately adjacent the nozzle orifice, it is now determined that this is a localized phenomenon and that, because of the spreading of the spray pattern and decrease in the mass-velocity per area downstream of the nozzle, flesh injection will not occur at points remote from the nozzle opening.

It would therefore be an advance in the art to provide a safety nozzle assembly for spray pistols which would prevent injection of human flesh by the spray from the nozzle within the critical area downstream of the nozzle before the spray pattern has increased to the point at which injection cannot occur.

SUMMARY OF THE INVENTION

My invention provides a safety nozzle assembly for airless spray pistols which includes a guard member affixed to the spray pistol around the nozzle and forming a sleeve encircling the spray pattern downstream of the nozzle. The guard member extends downstream of the nozzle a distance sufficient to enclose the critical area in which injection of human flesh can occur.

The guard member is specifically designed to be used in connection with spray nozzles which produce a fan-like spray pattern. In the illustrated embodiment, the guard member includes a fan-shaped sleeve member having a substantially elongated oval or rectangular cross-section which decreases in cross-section to a point adjacent the nozzle. The guard member then increases in cross-section and becomes circular providing an internal wall configuration to receive the spray nozzle. Additional fastening means are provided for attaching the guard member to the spray pistol. In one illustrated embodiment, the fastening mean includes a collar portion which is received around a standard tip nut which has been formed with an outer diameter groove therein. A set screw through the wall of the collar engages the groove to lock the guard member on the spray pistol tip nut. This particular embodiment is especially adapted for retro-fit of existing spray pistols.

In a second illustrated embodiment, the guard member has a tip nut attached to it through a connection which allows the guard member to be rotated independently of the tip nut. In this embodiment, the combination guard member-tip nut is used to affix both the guard member and the nozzle tip to the spray pistol thereby assuring that the pistol cannot be operated without the guard member attached. In a further modification, means are provided so that when the guard member is rotated, the tip nut is also rotated. This maintains alignment of the major diameter of the fan spray with a major diameter of the elongated oval or rectangular cross-section guard member.

Further, I have provided a radius curvature at the discharge end of the guard member with the radius generated from adjacent the nozzle orifice.

It is therefore an object of this invention to provide a safety nozzle assembly for airless spray guns which has a guard member concentrically surrounding the nozzle orifice and projecting downstream of the orifice providing a barrier shield around the spray pattern, the shield having a length sufficient to prevent injection of human flesh by the spray pattern.

It is another and more detailed object of this invention to provide a safety nozzle assembly for airless spray guns wherein a guard member surrounds the nozzle tip and extends downstream of the nozzle tip a distance sufficient to prevent injection of human flesh at the end of the guard member remote from the nozzle tip by the spray from the nozzle, the nozzle providing a fan-like spray and the guard member having an increasing cross-section downstream of the nozzle with an internal configuration similar to the spray pattern configuration providing peripheral clearance for the spray pattern.

It is a general object of this invention to prevent injection of human flesh by the discharge from airless spray pistols by providing a guard member shielding the spray pattern in that area downstream of the pistol in which injection of human flesh by the spray can occur, the shield member being configured to radially enclose the spray pattern with clearance.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a perspective view of an airless spray pistol equipped with the guard member of this invention.

FIG. 2 is a fragmentary end plan view of the pistol and guard member of FIG. 1.

FIG. 3 is a fragmentary cross-sectional view taken along the lines III—III of FIG. 2.

FIG. 4 is a cross-sectional view taken along the lines IV—IV of FIG. 3.

FIG. 5 is a fragmentary view, partially in section, similar to the view of FIG. 3 illustrating another embodiment of this invention.

FIG. 6 is an end plan view similar to FIG. 2 illustrating the embodiment of FIG. 5.

FIG. 7 is a cross-sectional view taken along the lines VII—VII of FIG. 5.

FIG. 8 is a fragmentary cross-sectional view taken along the lines VIII—VIII of FIG. 7.

DESCRIPTION OF THE PREFERRED EMBODIMENTS

FIG. 1 illustrates an airless spray pistol assembly 10 which includes a pistol body 11 with a depending handle portion 12 which is connected to a pumped fluid conduit 13 through a swivel connection 14. The body 11 has internal passageways therethrough, including a valve controlled by a trigger 15, which port the pumped fluid from the conduit 13 to a spray nozzle 16. An adjustment device 17 allows control of the spray 20 discharged from the nozzle 16. A guard member 18 surrounds the nozzle 16 and extends downstream thereof encompassing the spray pattern 20 from the nozzle 16 to a guard member discharge end 21. A tip nut 19 retains the guard member 18 and the nozzle 16 in place on the body 11.

As best shown in FIGS. 2 and 3, the nozzle 16 includes a tip 25 having a nozzle defining body 26 therein which defines the nozzle orifice 27. The nozzle defining body 26 may be received in a bore 28 within the nozzle tip 25 and the tip has an axially outturned outer diameter ledge forming end 29. The nozzle orifice 20 may open in a groove 31 in the orifice end of the tip 25, the groove being bounded by axially extending lands 30.

In the embodiment illustrated in FIGS. 1 through 4, the guard member 18 consists of a shield device which has an attachment end 40 which is generally circular in cross-section and which encircles a portion of the tip 25 substantially in contact with the outer periphery of the tip 25. A diverging portion 41 extends from the attachment portion 18 to the discharge end 21. As illustrated in FIG. 2, the diverging portion 41 consists of top 42 and bottom 43 spaced apart walls and side walls 44 and 45. As illustrated in FIG. 2, the side walls 44 and 45 may be curved so that the cross-section of the diverging portion at any point is similar to an elongated flattened oval. In such a construction, the top and bottom walls 42 and 43 may also diverge from each other by an angle which is considerably less than the angle of divergence of the side walls 44 and 45 or the top and bottom walls may be parallel. In addition the side walls 44 and 45 may be straight or vertical as viewed in FIG. 2 presenting a cross-section equivalent to an elongated rectangle.

The discharge end 21 is arcuately curved along a radius which is substantially generated adjacent the nozzle tip 25. In general, the radius would have a center point located co-axially with the orifice 27, preferably axially upstream of the orifice.

The angle of divergence of the walls 44 and 45 is chosen with respect to the spray pattern produced by the orifice 27. Most airless spray pistols are equipped with a slot-like orifice 27 which produces an oval spray pattern having a major and a minor diameter. A typical nozzle will produce a spray pattern having a major diameter of 8 inches one foot downstream of the nozzle and a minor diameter on the order of 2 inches at one foot downstream of the nozzle. Such spray patterns are highly desirable, and when used in connection with spray painting, provide for a quality paint application which cannot easily be obtained with conical spray patterns. Therefore the angle of divergence of the walls 44 and 45 should be the same as or slightly greater than the included angle of the major diameter of the spray pattern from the orifice 27. In order to provide clearance between the boundaries of the major diameter of the spray pattern and the interior surfaces of the walls 44 and 45, the angle of divergence may be slightly greater than the included angle of the major diameter or the divergence of the walls may initiate from a point axially upstream of the nozzle orifice.

A guard member of the type depicted herein will effectively prevent accidental access of the flesh of a user to the paint stream in the area in which the stream can penetrate human skin. It has been determined that this area includes the area less than 0.58 inches from the nozzle orifice. In some instances, the area in which penetration can occur can extend outwardly to three quarters of an inch. In addition, since it is desired to protect not only against accidental entry of flesh into the area but to also protect against insertion of a finger into the discharge end, further extension of the guard member may be desirable. However, the guard member will have a dimension downstream of the orifice to the open end 21 of at least 0.58 inches.

In order to avoid interference with the spray, the vertical dimension as illustrated in FIG. 2 of the guard member will be equivalent to at least the minor diameter of the spray pattern. In those instances where the top and bottom walls 42 and 43 diverge, that dimension will be maintained adjacent the nozzle and will increase outwardly therefrom. Since the dimension should always provide clearance on both sides of the spray pattern and since the spray pattern is no sharply defined, the dimensions will be greater than indicated by the aforementioned description of the spray pattern. However, in the preferred embodiment, the top and bottom walls 42 and 43 are parallel and therefore the top and bottom walls will be spaced apart continuously a distance greater than the minor diameter of the spray pattern at the outlet end 21. In the embodiment illustrated, this distance is increased to a distance equal to the diameter of the tip 25 so that there is no internal diameter reduction axially of the tip.

In addition, it is desired to provide a guard member which will always be in alignment with the spray pattern. In order to provide this, I have provided rotation locking means between the guard member and the tip. As illustrated in FIGS. 2 and 3, the anti-rotation means may include radially inwardly extending tangs 47 which project inwardly into the groove 31 between the land 30.

Another method of obtaining the same anti-rotation feature is to provide opposed flats 51, illustrated in FIG. 4, on both the outer surface of the tip 25 and the inner diameter of the attachment end 40.

However, it is necessary that the tip 25 be rotatable with respect to the spray gun in order to allow rotation of the spray pattern to a different orientation with respect to the gun. In order to provide this, I have attached the attachment end 40 of the guard member to the tip nut 19 through a locking ring 50 which indexes in a groove in the tip nut adjacent the end thereof and in a groove in the outer diameter of the attachment section 40 of the guard member adjacent the axial end of the attachment section.

FIGS. 5 through 8 illustrate a modified form of the invention wherein the guard member 58 is attachable to substantially standard tip nut 59-tip 60 combinations.

The guard member includes an enlarged circular attachment end 61 having a tapered inner diameter portion 62 which is dimensioned to be received around the standard prior art tip nuts 59. The tapered inner diameter terminates at a radial wall 63 formed as an axial end portion of a diameter reducing section 64 which is integral with the outwardly diverging tip guard portion 65 through an outer radius bend 66 as illustrated. The inner diameter wall 67 of the diameter reducing section 64 engages the outer peripheral surface 68 of the tip 60. In this embodiment the dimensioning of the inner diameter 67 of the diameter reducing section 64 from the radial wall 63 to the outwardly diverging walls is such that, in combination with the inturned end lip 70 of the tip nut, that the orifice 71 will be properly spaced within the guard member. A set screw 75 extends through the attachment end portion and engages in a groove 76 which may be formed in the outer diameter of the tip nut 59. Although in other embodiments, the set screw can have a more pointed end and can be utilized independently of the groove 76, the provision of the groove assures that the guard member will be firmly affixed to the spray pistol.

As in the case with the embodiment of FIGS. 1 through 4 the diverging portion of the tip guard includes diverging side walls 84 and 85 and top and bottom walls 82 and 83 which may diverge or which may be parallel as illustrated. The minimum dimension between the top and bottom walls 82 and 83 is substantially the same as the diameter of the tip 60 and the walls 84 and 85 diverge outward from adjacent the tip with the walls having a line of intersection located axially behind the tip orifice. The angle of divergence of the walls 84 and 85 is at least equal to the included angle of the major diameter of the spray pattern.

Again, in the previous embodiment, the walls 84 and 85 may be rounded as illustrated in the FIG. 6 producing a cross-section shape similar to an elongated flattened oval. In other embodiments the walls 84 and 85 may be other shapes, for example, planar, producing a cross-sectional shape of an elongated rectangle. The discharge end 90 is preferably arcuate having a radius which is generated from adjacent the tip orifice, or in the example illustrated, which is generated from the point of intersection of the walls 84 and 85. Again, in this embodiment, there can be means provided preventing independent rotation of the tip and the guard member. For example the flats illustrated in FIG. 4 may be utilized on the periphery 68 of the tip and the axial wall 67 of the guard member.

It can therefore be seen from the above that my invention provides a safety nozzle assembly for airless spray pistols which includes a guard member having top, bottom and side walls which extend outwardly beyond the tip orifice a distance sufficient to prevent injection of human skin at the open discharge end of the guard member. The guard member side walls diverge outwardly from adjacent the orifice with an angle of divergence at least as great as the included angle of the major diameter of the spray pattern and the distance between the top and bottom walls is maintained greater than the maximum minor diameter of the spray pattern throughout the length of the guard member.

The guard member has an arcuately curved discharge end with the arc generated from a radius having a center line adjacent the tip orifice thereby minimizing the guard member's influence on the spray while maintaining the protective distance from the discharge end to the orifice. Means are provided to rotate the shield with respect to the pistol and to prevent rotation between the shield and nozzle tip.

Although the teachings of my invention have herein been discussed with reference to specific theories and embodiments, it is to be understood that these are by way of illustration only and that others may wish to utilize my invention in different designs or applications.

I claim as my invention

1. a safety nozzle guard for airless spray pistols comprising: in combination, a spray pistol having a nozzle outlet producing a fanlike spray pattern, a guard, and means for attaching the guard to the pistol adjacent the nozzle, the guard having an attachment end having a substantially circular cross-section attachable to the spray pistol radially of the nozzle outlet and discharge end having a substantially elongated cross-section between top, bottom and two side walls, the discharge end spaced from the attachment end by continuous walls which are dimensioned similarly to the spray pattern and which increases in internal cross-section downstream of the outlet, the discharge end being curved substantially on a radius generated adjacent the attachment end.

2. A nozzle guard for airless spray pistols comprising: a guard member having an open body with top, bottom and two side walls, an attachment end and a discharge end, the attachment end having an internal wall configuration adapted to mate with external surfaces of a spray nozzle assembly received therein, the side walls diverging from the internal wall configuration to the discharge end, the top and bottom walls diverging from adjacent the internal wall configuration to the discharge end at an angle less than an angle of divergence of the side walls, the top and bottom walls projecting beyond the side walls at the discharge end.

3. The guard of claim 2 wherein the top and bottom walls are arcuately curved from side wall to side wall at the discharge end.

4. The guard of claim 3 wherein the top and bottom walls are substantially parallel from adjacent the internal wall configuration to the discharge end and have a distance therebetween which is greater than the maximum distance of the minor diameter of a spray pattern produced by a spray nozzle receivable therein.

5. The guard of claim 3 wherein the discharge end is arcuately curved along a radius generated from adjacent the internal wall configuration.

6. The guard of claim 2 wherein means are provided for allowing rotation of the guard with respect to a spray piston to which the guard is attached while maintaining the attachment.

7. The guard of claim 6 wherein means are provided for preventing relative rotation between the guard and a nozzle assembly receivable therein.

8. An airless spray pistol assembly comprising in combination: a spray pistol having internal passageways discharging through the orifice of a pistol attached nozzle, the orifice producing a fan-like spray pattern downstream of the pistol, a guard member having an attachment end attached to the pistol adjacent the nozzle with the orifice discharging internally of the guard member, the guard member having a substantially continuous walled hollow body extending from the attachment end to a discharge end spaced from the attachment end a distance sufficient to prevent injection of human flesh at the discharge end by the spray pattern, the body increasing in internal cross-section from adjacent the nozzle to the discharge end and having at least two opposed diverging wall portions, the increase in body internal cross-section from the nozzle to the discharge end being proportional to an increase in the cross-sectional area of the fan-like spray pattern.

9. A spray tip nozzle and guard assembly for airless paint spray pistols comprising: a nozzle member having a body with a nozzle orifice open to an axial end, and an outer peripheral surface, a guard member having an attachment end and a discharge end, means associated with the guard member for attaching the attachment end to a paint spray pistol with the nozzle member received at least partially within the guard member adjacent the attachment end, the guard member having an internal surface configuration adjacent the attachment end receiving the peripheral surface of the nozzle member with the nozzle orifice discharging to the interior of the guard member in the direction of the discharge end, the nozzle orifice providing a fan-like spray pattern downstream of the orifice with a major and minor diameter, a wall portion of the guard member extending from the attachment end to the discharge end, the wall portion having opposed portions diverging from one another from adjacent the attachment end to the discharge end, an angle of divergence of the opposed wall portions greater than an included angle of the major diameter of the spray pattern internally of the guard member whereby the spray pattern will not contact the opposed diverging walls of the guard member, the guard member extending beyond the nozzle orifice when the nozzle member is received within the guard member by a distance sufficient to prevent injection of human flesh located at the discharge end by the spray pattern from the orifice, and means preventing relative rotation between the guard member and the nozzle member.

10. A safety spray tip assembly for airless paint spray pistols comprising: a nozzle member having a nozzle orifice therethrough, a hollow guard member having an attachment end and a discharge end, the nozzle member received at least partially interiorly of the guard member adjacent the attachment end, means restricting independent axial and rotational movement of the guard member and nozzle member, the guard member having a continuous wall portion extending from adjacent the nozzle orifice to the discharge end, the discharge end spaced from the nozzle orifice a distance sufficient to prevent injection of human flesh located at the discharge end by a stream of fluid exiting the nozzle orifice during normal operation of the spray pistol, the guard member having an internal configuration downstream of the nozzle orifice similar to a configuration of the spray pattern from the nozzle orifice providing clearance therewith, the guard member preventing access to the spray pattern interior of the guard member except through the discharge end.

* * * * *